United States Patent [19]

Bradshaw

[11] 3,975,466

[45] Aug. 17, 1976

[54] CARBURETOR AUXILIARY FLUID INJECTOR

[75] Inventor: George W. Bradshaw, Detroit, Mich.

[73] Assignees: Peter Lilicy; Peter G. Lilicy, both of Southgate, Mich. ; part interest to each

[22] Filed: Apr. 10, 1975

[21] Appl. No.: 566,660

[52] U.S. Cl. ..... 261/18 A; 261/22; 261/23 A; 123/25 R; 55/DIG. 28

[51] Int. Cl.[2] ..... F02M 25/04

[58] Field of Search ..... 261/18 A, 16, 22, 23 A; 123/25 R, 25 A; 55/DIG. 28

[56] References Cited

UNITED STATES PATENTS

| | | | |
|---|---|---|---|
| 2,329,248 | 9/1943 | Carlson | 55/DIG. 28 |
| 2,407,478 | 9/1946 | Crozier et al. | 261/18 A |
| 2,606,537 | 8/1952 | Baumheckel | 261/18 A |
| 2,642,852 | 6/1953 | Bester | 261/18 A |
| 2,715,395 | 8/1955 | Finvold | 261/16 |
| 2,717,149 | 9/1955 | Anderson | 261/18 A |
| 2,811,146 | 10/1957 | Spillmann | 123/25 A |
| 2,946,575 | 7/1960 | Rohr | 261/16 |
| 3,726,511 | 4/1973 | Jones | 55/DIG. 28 |

*Primary Examiner*—Tim R. Miles
*Attorney, Agent, or Firm*—Hauke & Patalidis

[57] ABSTRACT

An attachment for introducing fluid to the air intake of a carburetor of an internal combustion engine has at least one open-ended barrel in the form of a tube positioned in the air intake stream of a carburetor with the axis of the barrel in parallel alignment with the air flow. The attachment includes a fluid reservoir and tubing for the passage of fluid from the reservoir to an orifice leading into the bore of the barrel. The barrel may have a venturi configuration. Thus, the passage of carburetor intake air through the bore of the barrel creates a suction which draws fluid into the bore where it is atomized and vaporized.

6 Claims, 9 Drawing Figures

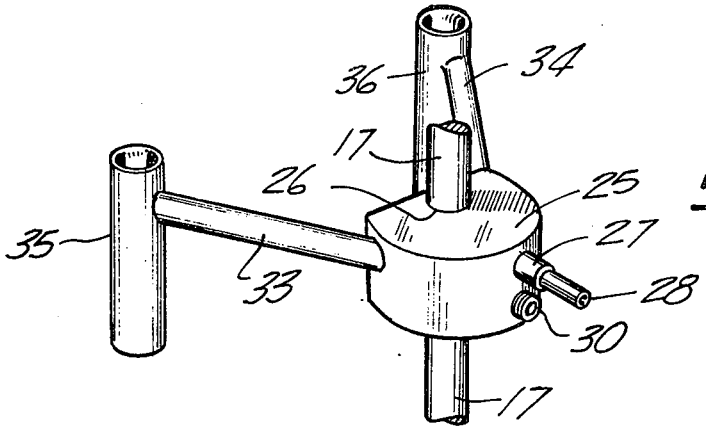
Fig-4
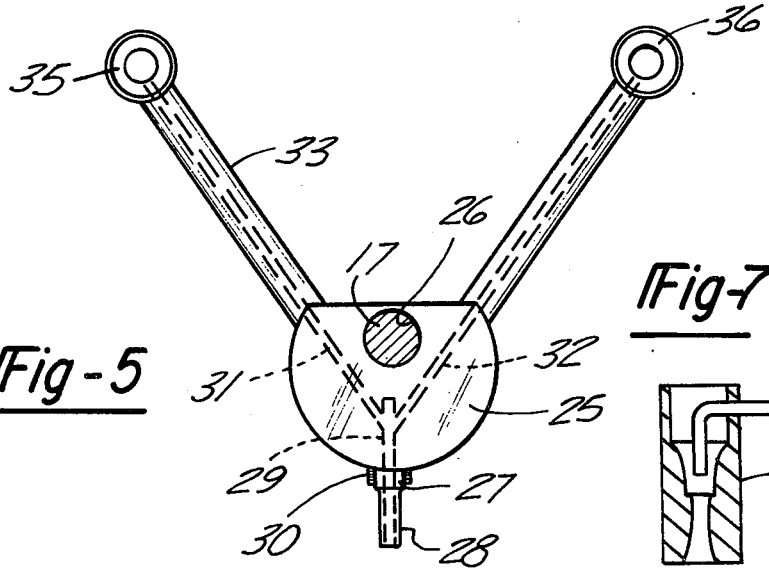
Fig-5
Fig-7
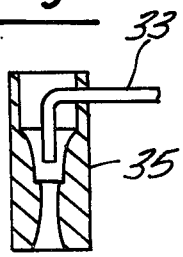
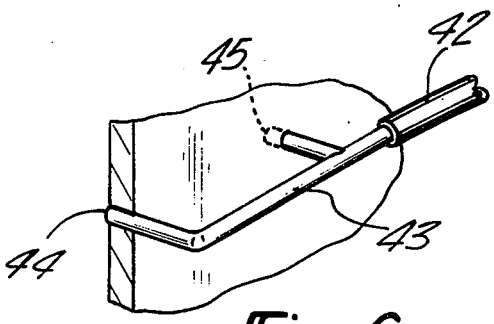
Fig-6
Fig-8
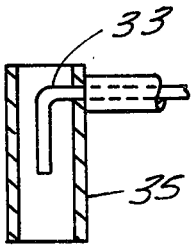
Fig-9
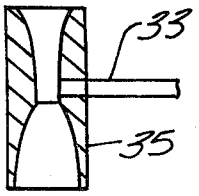

CARBURETOR AUXILIARY FLUID INJECTOR

BACKGROUND OF THE INVENTION

It has long been appreciated that the addition of fluids, liquid fluids such as water, ethyl alcohol, methyl alcohol and the like, as well as gaseous fluids such as methane, ethane, propane, butane, and the like, to the fuel-air charge admitted to the combustion chambers of internal combustion engines produces advantages such as lower carbon deposits and permits the use of a lower grade of fuel without decrease in engine performance. Many patents have issued on structures for introducing water, for example, to engine combustion chambers. For example, Benjamin U.S. Pat. No. 1,280,643 discloses a system in which water vapor from the cooling system of an internal combustion engine is connected to a carburetor at a point between the throttle valve and fuel spray nozzle.

Bowman U.S. Pat. No. 1,890,107 discloses a system for introducing water to the intake manifold of an internal combustion engine. Adair U.S. Pat. No. 2,431,679 discloses a structure in which water is introduced to the carburetor between the choke and the fuel inlet. Garrigus U.S. Pat. No. 2,493,808 discloses a system in which water in finely atomized form is injected into the fuel charge in the manifold of an internal combustion engine.

Vanderpoel U.S. Pat. No. 2,676,577 discloses a system for introducing a fluid such as water or a mixture of water and alcohol, etc., to the intake manifold of an internal combustion engine. Rosenthal U.S. Pat. No. 2,810,561 discloses a system for supplying a highly mixed and vaporized quantity of a special liquid mixture from a container to the intake manifold of an internal combustion engine. Stoltman U.S. Pat. No. 3,034,487 discloses a system for injecting water at the venturi section of a carburetor used in a supercharged internal combustion engine.

The above-listed patents are characterized as being rather cumbersome in structure. Of necessity, these structures would need to be incorporated in internal combustion engines at the time of the assembly thereof. The present invention is directed to an attachment which can be easily and quickly added to an existing engine to provide a means for introducing fluid to the intake air thereof.

SUMMARY OF THE INVENTION

The invention provides an attachment for introducing fluid to the air intake of a carburetor of an internal combustion engine. It consists of at least one open-ended barrel preferably having a venturi configuration which may be readily positioned in the air intake of a carburetor, the barrel being axially parallel with the direction of air flow to the carburetor and providing unobstructed fluid and air flow to the carburetor. The attachment includes tubing means for conveying fluid to the bore of the barrel whereby the passage of carburetor air through the barrel bore creates a suction which draws fluid from a reservoir into the barrel bore where it is atomized and vaporized and passed through the carburetor.

BRIEF DESCRIPTION OF THE DRAWINGS

FIG. 4 is a perspective view of the attachment illustrated in FIG. 1;

FIG. 5 is a plan view of the arrangement illustrated in FIG. 4 with fluid flow passageways indicated by dotted lines;

FIG. 6 is an enlarged broken perspective view of an auxiliary fluid-introducing means as illustrated in FIG. 1; and FIGS. 7–9 are examples of configurations of the means for introducing fluid of the invention, shown in longitudinal section.

DESCRIPTION OF THE PREFERRED EMBODIMENTS

Figure 1:
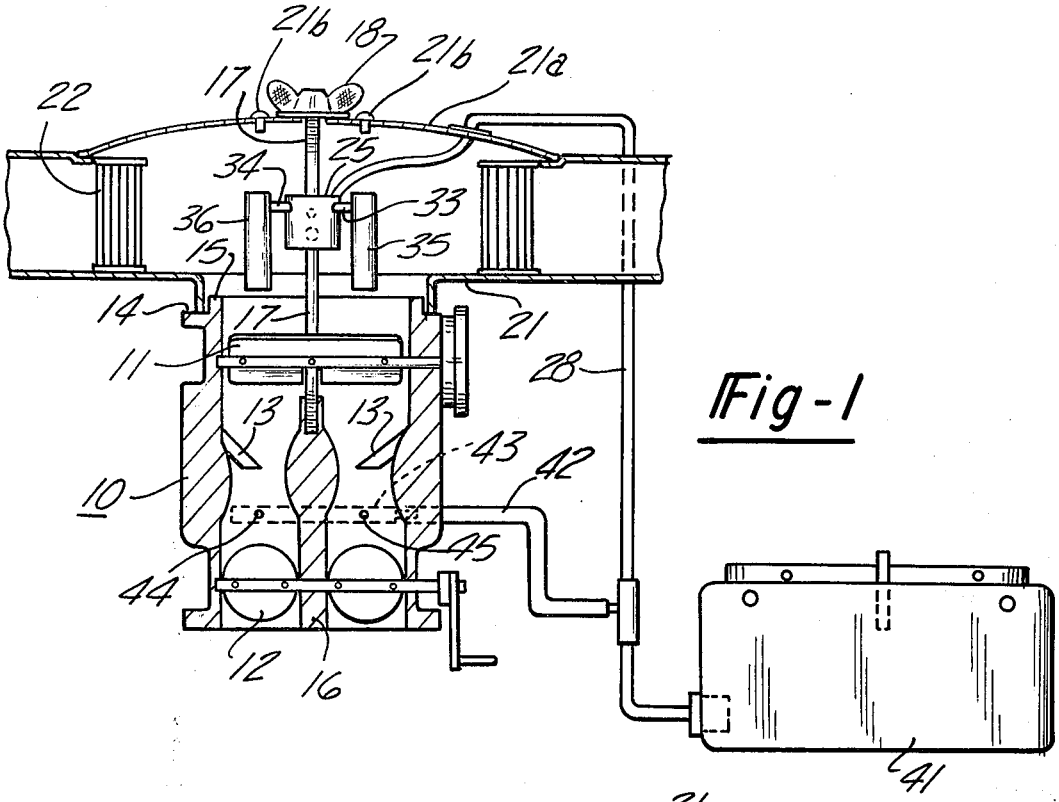
FIG. 1 is a partially cross-sectional view of a carburetor, air intake filter and reservoir, which includes the attachment of the present invention.

The device of the present invention provides a means for quickly and easily providing fluid introduction to an internal combustion engine, and particularly to a gasoline engine, which has been previously operated without having a means for fluid introduction. The engine to which the invention is applied is conventional in all respects. Accordingly, only those parts which are necessary to illustrate the invention have been included in the drawings.

Referring particularly to FIG. 1, a conventional two-barrel carburetor 10 as illustrated schematically, including a choke valve 11, a throttle valve 12 disposed in each barrel, and a pair of fuel inlet jets 13. The upper end of the carburetor 10 includes a flange 14 from which a lip 15 protrudes. The two barrels of the carburetor 10 are separated by a wall 16 which has a centrally disposed threaded aperture at its upper end to accommodate the threaded end of a rod 17 which, in cooperation with a wingnut 18, maintains in position the cover 21*a* of an air filter housing 21. The bottom portion of the air filter housing 21 seats against the flange 14 and is centered by the lip 14 of the carburetor 10. A conventional air filter 22 is positioned within the air filter housing 21. The rod 17 which serves to hold down the air filter housing cover 21 a also serves as a means for mounting and positioning the fluid-introducing attachment of this invention in the intake air stream of the carburetor 10.

Referring particularly to FIGS. 4 and 5, the attachment comprises a mounting member 25 having a mounting aperture 26 for mounting on the rod 17 in an appropriate height position over the intake of carburetor 10. The mounting member 25 includes a nipple 27 to which a tube 28 for feeding the fluid is attached. The nipple 27 leads to an internal passageway 29 (FIG. 5) which in turn forks into internal passageways 31 and 32. Thus, the mounting member 25 also serves as a fluid flow divider member.

A pair of rigid tubes 33 and 34 are connected to the mounting member 25 at the outlets of the passageways 31 and 32. At the extended end of the tube 33 there is an open-ended barrel 35 and at the extended end of the tube 34 there is an open-ended barrel 36. The barrels 35 and 36 preferably have converging-diverging internal venturi configuration as shown at FIGS. 7 and 9. The barrels 35 and 36 are drilled at the point of connection of the tubes 33 and 34 to give access to fluid flowing through the tubes 33 and 34 to the bores of the barrels 35 and 36. The tubes 33 and 34 lead into the barrels 35 and 36 at a point where the venturi configuration begins to diverge as shown at FIG. 9. Thus, air passing through the bores of the barrels 35 and 36 exerts a suction force on the interior of the tubes 33 and 34 and draws fluid through the tube 28. Alternatively, the tubes 33 and 34 may project part of the way along the longitudinal axis of the barrels 35 and 36, as shown at FIGS. 7 and 8. Optionally, auxiliary air inlets, as shown at 21*b* may be disposed through the air filter cover 21*a*, each auxiliary air inlet being disposed in alignment above one of the nozzles 35–36.

Figure 3:
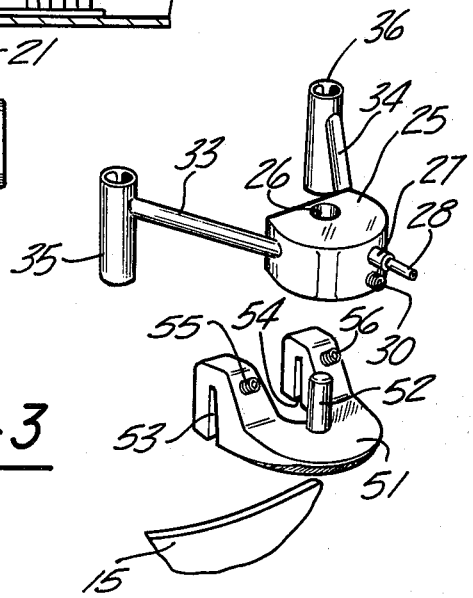
FIG. 3 is an exploded perspective view of the attachment parts illustrated in FIG. 2.

The mounting member 25 is fastened upon the shaft 17 by means of a set screw 30 (FIGS. 3 and 4). As shown in FIG. 1, the mounting member 25 is positioned such that the outlets of the barrels 35 and 36 are immediately adjacent the carburetor intake and with the axes of the barrels parallel with the direction of air flow. In this manner, there is substantially unobstructed fluid flow from the barrels 35 and 36 to the carburetor.

In FIG. 1, the fluid flow tube 28 is shown as leading from a fluid reservoir 41. FIG. 1 also shows a second fluid-introducing means connected to the fluid reservoir 41 by means of a tube 42. The tube 42 is connected to a fluid manifold 43 (best shown at FIG. 6) having a pair or outlets or orifices 44 and 45 through which fluid is drawn from the manifold 43. Fluid from the manifold 43 enters the carburetor feed stream after fuel has been introduced through the fuel jets 13. Thus, the fluid-introducing means represented by the manifold 43 is less efficient than the fluid-introducing means represented by the barrels 35 and 36 at the carburetor intake, as the fluid manifold 43 introduces fluid in an already saturated fuel-air mixture. The manifold 43 does not lend itself readily to an after-market installation. However, it is shown by way of emphasizing that a single engine may be provided with two fluid-introducing means.

Figure 2:
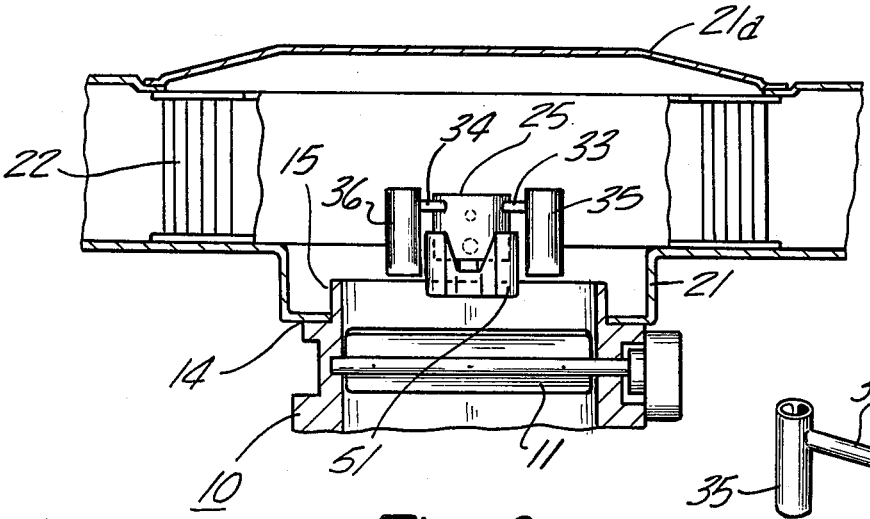
FIG. 2 is an enlarged view of a portion of the assembly of FIG. 1 showing an alternative structure for mounting the attachment of this invention.

Some carburetors are not equipped with an air filter rod 17. Such a carburetor is illustrated at FIG. 2. For use with such a carburetor, the mounting member 25 is mounted upon an adapter 51 as shown at FIGS. 2 and 3. The adapter 51 is a U-shaped bracket having a perpendicularly positioned pin 52 at its apex. The pin 52 is dimensioned for accommodation through the aperture 26 of the mounting member 25. The extending legs of the adapter 51 are provided with slots 53 and 54 to enable the adapter to be mounted upon the lip 15 of the carburetor 10. A pair of set screws 55 and 56 may be tightened to maintain the adapter on the lip 15 after it has been positioned theron. The barrels 35 and 36 are similarly positioned over the carburetor intake whether their mounting is as shown in FIG. 1 or as shown in FIG. 2.

While the invention has been illustrated with a two-barrel arrangement, it should be emphasized that a single barrel is sufficient, particularly with four- or six-cylinder engines. Where a single barrel is used, the mounting member 25 has a single fluid passageway bored therethrough.

The two-barrel fluid injector illustrated in FIGS. 1 and 2 is satisfactory for introducing fluid to larger engines such as the eight-cylinder engines used in many passenger automobiles today. For still larger engines, a configuration having three or more barrels may be used.

It is not contemplated that the present invention be limited as to the type of fluid to be used. Water is to be recommended for its cheapness and availability. However, pure water would present problems for operation at temperatures below freezing. Fluids can be adjusted as to composition to accord with the climate in which the engine is operating. For example, where freezing temperatures are encountered ethyl-alcohol or methyl-alcohol is a desired additive for water. Soluble solid materials may be present in the formulation. It is not necessary that the reservoir 41 serve the sole purpose of providing fluid-introducing additives to the engine. For example, many windshield washer compositions could function as effective engine operation additives. Under these circumstances, the reservoir 41 can be the windshield washer reservoir already present in most automobiles.

Since the flow of air to a carburetor is dependent upon engine operating conditions, the flow of fluid in this invention is automatically metered. As the engine speeds up and draws more air into the carburetor, more air is drawn through the barrels 35 and 36 to increase the suction through the tube 28 which in turn draws fluid from the reservoir 41 at a higher rate. This fluid entering the engine permits the engine to operate at lower temperatures without loss of efficiency. It also permits use of regular or no-lead fuels in high compression engines with no reduction in performances and without causing "knocking" or "pinging". At the same time, the engine and spark plugs are kept cleaner by reducing carbon deposits. The catalysts in catalytic converters will be maintained in cleaner condition, and catalyst poisoning is eliminated or reduced.

Upon initial mixing of the fluid with air in the bore of the barrels 35 and 26, the fluid becomes atomized. A portion may also be vaporized. As the mixture proceeds through the carburetor and intake manifold heat is added and a larger proportion of the fluid particles become vaporized. This vapor can replace a portion of the vaporized fuel particles. Maximum power in an engine will be obtained at a fuel-air ratio of about 0.080. Fuel enrichment beyond this ratio results in a power decrease. If a portion of the fuel is replaced by the fluid additives of this invention, enrichment of the fuel-air ratio beyond the optimum proportion does not have such a drastic effect upon engine performance. Thus, the use of fuel additives, liquid as well as gaseous, in accordance with this invention results in satisfactory engine performance under a wider variety of fuel-air conditions.

I claim:

1. An attachment for introducing a fluid to the air intake of a carburetor of an internal combustion engine having an air filter and fuel injector nozzles, said attachment being for mounting within said air filter and comprising:

a source of said fluid;

at least one open-ended barrel having a through bore;

means for holding said barrel in the air intake of said carburetor in a position whereby said barrel is axially parallel with the direction of air flow to said carburetor; and means for conveying said fluid from said source of fluid to the bore of said barrel whereby the passage of carburetor intake air through said bore draws said fluid into said bore where it is atomized and vaporized;

wherein said holding means includes a mounting member having an aperture axially parallel to said barrel for mounting said member on a support rod and said means for conveying fluid to the bore of said barrel is a rigid hollow tube having an end leading into the bore of said barrel and another end connected to said mounting member, said other end being in fluid communication with said source of said fluid.

2. An attachment as claimed in claim 1 which further comprises an auxiliary fluid-introducing means positionable downstream with respect to the fuel injector nozzles of said carburetor, said auxiliary fluid-introducing means comprising a manifold connected for the flow of said fluid thereto and at least one fluid-introducing orifice leading from said manifold into said carburetor downstream of said nozzles.

3. An attachment as claimed in claim 1 in which the support rod is the mounting rod of the air filter of said carburetor.

4. An attachment as claimed in claim 1 further comprising a U-shaped adapter having extending legs defining slots for mounting said adapter on the lip at the air intake end of the carburetor, a cylindrical pin positioned at the apex of said adapter, said pin being axially parallel with the direction of air flow when said adapter is mounted on said carburetor and said pin defining said support rod for mounting of said mounting member thereon.

5. An attachment as claimed in claim 1 in which there are at least two barrels spaced from, and connected by said hollow tubes to said mounting member and a fluid flow divider disposed in said mounting member between said hollow tubes and said source of fluid for feeding said fluid to the bores of said barrels.

6. An attachment as claimed in claim 5 in which the barrels are venturi tubes.

* * * * *